United States Patent [19]

Marchisio

[11] 4,331,007

[45] May 25, 1982

[54] CIRCULAR KNITTING MACHINE WITH A DEVICE FOR ADJUSTING THE STROKE OF THE CYLINDER NEEDLES

[75] Inventor: Giovanni Marchisio, Turin, Italy

[73] Assignee: Giovanni Marchisio & C. S.a.s., Turin, Italy

[21] Appl. No.: 902,633

[22] Filed: May 4, 1978

[30] Foreign Application Priority Data

May 18, 1977 [IT] Italy ..... 68131 A/77

[51] Int. Cl.[3] ..... D04B 15/32

[52] U.S. Cl. ..... 66/55

[58] Field of Search ..... 66/54, 27, 23, 55

[56] References Cited

U.S. PATENT DOCUMENTS

| | | | |
|---|---|---|---|
| 1,952,928 | 3/1934 | Lawson | 66/8 |
| 2,004,260 | 6/1935 | Welch et al. | 66/8 |
| 2,495,872 | 1/1950 | Stibbe et al. | 66/27 |
| 2,740,274 | 4/1956 | Lebocey | 66/8 |
| 3,076,327 | 2/1963 | Coile | 66/54 |
| 3,882,694 | 5/1975 | Stepanek et al. | 66/54 |
| 3,959,994 | 6/1976 | Bertagnoli | 66/54 |

FOREIGN PATENT DOCUMENTS

| | | | |
|---|---|---|---|
| 1008860 | 5/1957 | Fed. Rep. of Germany | 66/54 |
| 1248173 | 9/1971 | United Kingdom | 66/54 |

*Primary Examiner*—Wm. Carter Reynolds

*Attorney, Agent, or Firm*—Sughrue, Mion, Zinn, Macpeak & Seas

[57] ABSTRACT

A multiple-feed circular knitting machine has an upright-axis needle cylinder coaxially surrounded by an annular base plate and a sector-support plate supported thereon for axial sliding movement relative thereto and in turn supporting sectors of a cam-support ring bearing cams which control the axial movements of needles of the needle cylinder, the sector-support plate being supported by grub screws projecting below the plate and bearing on respective inclined upper faces of equal slope in the same circumferential direction of wedge-shaped blocks fixed to a setting ring carried on the base plate, and the machine having a graduated control which operates a pinion meshed with peripheral teeth of the setting ring to rotate the ring in either sense relative to the sector-support and base plates to make the grub screws ride up or down the respective inclined faces to raise or lower the cams supported from the sector-support plate by the same amount simultaneously to adjust the vertical movements of the needles.

7 Claims, 5 Drawing Figures

CIRCULAR KNITTING MACHINE WITH A DEVICE FOR ADJUSTING THE STROKE OF THE CYLINDER NEEDLES

The present invention relates to a multiple-feed circular knitting machine of the type having an upright-axis needle cylinder rotatably mounted in a frame, a cam-support ring carrying the cams which control the vertical movements of the cylinder needles, the cam-support ring being constrained against rotation and subdivided into a plurality of sectors each fixed to an annular sector-support plate which coaxially surrounds the needle cylinder.

In known knitting machines of the aforesaid kind, the stitch effected by the needles is varied by adjusting the vertical movement or stroke of the needles with respect to the upper edge of the needle cylinder. Since the stroke is controlled by the cams which engage the heels of the needles, this involves adjusting the height of the cams with respect to the needle cylinder. To allow this adjustment, in known machines, each cam is fixed to a small bolt, axially slidable in a respective sector and urged upwardly by a respective spring, upward movement being prevented by a screw engaged with an inclined face of a conical recess formed in a portion of the bolt facing outwardly of the machine. Each screw has a control head (normally a knurled knob), manually operable from outside the respective sector to rotate the screw one way of the other whereby to depress the bolt against the action of the spring or to allow the bolt to rise, thus adjusting the height of the cam carried thereby relative to the needle cylinder.

Clearly, when it is required to vary the stitch effected by the needles in such known machines, it is necessary to adjust the height of the cams, sector by sector, and since there can be as many as 20–30 sectors, each having four bolts, this takes a considerable amount of time; and also adjustment is very difficult since the heights of all the cams must be varied by the same amount by independent adjusting means, which requires skilled personnel.

The object of the present invention is to provide a circular knitting machine of the type mentioned above, in which the adjustment of the stroke of the cylinder needles can be effected extremely simply and quickly, even when the machine is in operation, by causing the height of all the sectors and of their respective cams to change at the same time and strictly by the same amount.

According to the present invention there is provided a multiple-feed circular knitting machine having an upright-axis needle cylinder rotatably mounted in a frame and coaxially surrounded by annular sector-support means carrying sectors of a cam-support ring constrained against rotation and holding the cams which control the axial movements of the cylinder needles, the sector-support means being supported on the frame by an adjustable support assembly which is adjustable by common control means to vary the height of the sector-support means, and hence raise or lower the cams carried by the cam-support ring supported thereby by the same amount relative to the needle cylinder in order to vary the stroke of the cylinder needles operated on by the cams in use of the machine.

When it is desired to adjust the stitch of a knitting machine according to the invention, it suffices to operate the control means to effect the simultaneous raising or lowering of all the sectors and hence of their respective cams by the same amount. Such adjustment may even be carried out while the machine is working.

Preferably graduated means are associated with the control means whereby the height of the sector-support means may be varied by a predetermined amount.

Preferably, the said adjustable support means comprise a plurality of bearing members projecting below and spaced around an annular sector-support plate constituting, in a preferred embodiment, the sector-support means, each member bearing upon one of a corresponding number of ramps carried by a rotatable setting ring coaxial with the needle cylinder and supported from a fixed base plate, the ramps having equal slopes in the same circumferential direction and the common control means being operable from the exterior of the machine to cause rotation of the setting ring, in either sense, to cause the bearing members to ride up or down the respective ramps by the same amount to vary the height of the sector-support plate with respect to the cylinder.

In a preferred embodiment of the invention, the setting ring is formed with teeth around its periphery and the means for controlling the rotation of the said ring include a toothed pinion meshed with the teeth of the setting ring and keyed onto a rotatable shaft provided with operating means accessible from outside the machine.

As will be understood, this preferred embodiment is extremely simple both in terms of its structure and its operation.

One embodiment of the invention will now be more particularly described, by way of example, with reference to the accompanying drawings, in which.

Figure 2:
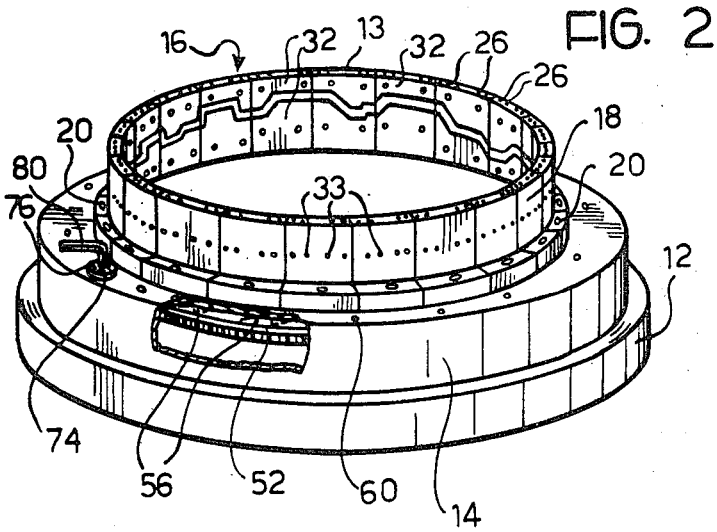
FIG. 2 is a perspective view, on a larger scale, of those parts of the machine of FIG. 1 including a device for adjusting the stroke of the cylinder needles.
Figure 1:
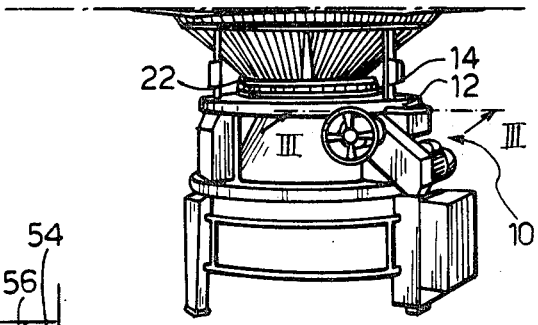
FIG. 1 is a perspective view of a multiple-drop circular knitting machine according to the invention.
Figure 3:
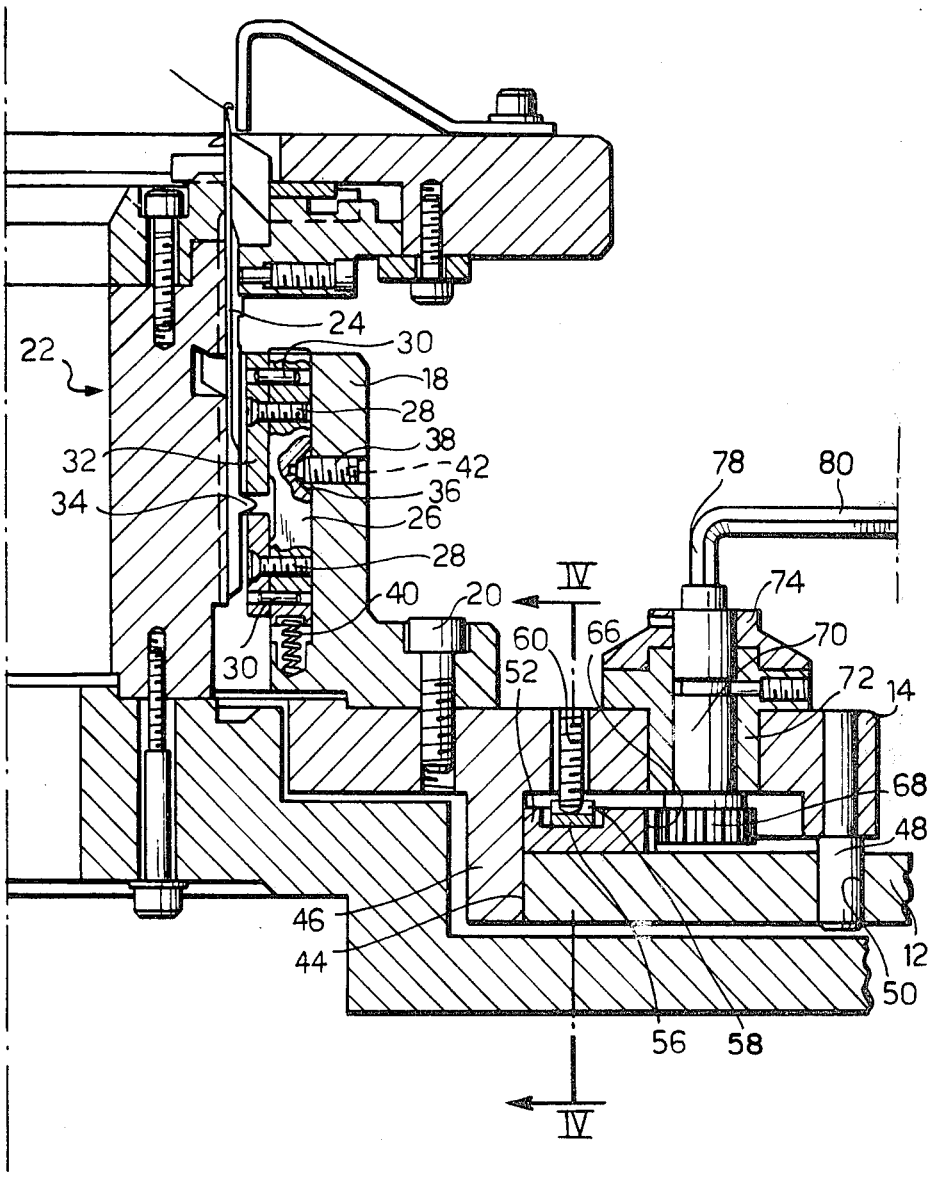
FIG. 3 is a sectional view, on a larger scale, taken on a diametral vertical plane, of part of the machine indicated by the line III—III of FIG. 1.

Referring to FIGS. 1 to 3 of the drawings, a multiple-feed circular knitting machine is shown having a frame generally indicated 10 to which is affixed an annular base plate 12. The base plate 12 supports an annular sector-support plate 14, which in turn, carries a cam-support ring 16 which is subdivided into a plurality of sectors 18, each bolted by respective bolts 20 to the annular plate 14. The two annular plates 12 and 14 and the ring 16 are constrained against rotation but surround coaxially a rotatable vertical axis cylinder 22, in the outer periphery of which are assembled, for vertical sliding movement, needles 24 of the machine.

The cam-support sectors 18 each carry, on their radially inwardly facing sides, conventional locks or cams 32 which engage respective heels 34 of the needles 24 and, in the course of rotation of the cylinder 22, in use of the machine, impart programmed vertical reciprocating movement to the needles 24 to effect knitting of yarn fed thereto. The cams 32 are in fact fixed to the respective sectors 18 by means of screws 28 and pins 30 which engage in respective bolts 26, slidingly assembled for vertical movement, four in each respective sector 18.

Each bolt 26 is urged upwardly by a respective compression spring 40, located beneath the bolt 26 with its axis vertical, and is restrained against vertical movement by a respective setting screw 38 located in a substantially radial throughbore in the respective sector 18. The radially inner end of each screw 38 is engaged with a lower inclined face of a radially-outwardly facing conical recess 36 formed in the respective bolt 26. The radially outer end of each screw 38 lies within the respective sector 18, and is provided with an hexagonal recess 42. Each screw 38 may be used to set the height of the respective bolt 26, and hence of the respective cam 32, relative to the cylinder 22: a radially inward displacement of a screw 38 causes lowering of the respective bolt 26 against the action of the corresponding spring 40 while a radially-outward displacement of a screw 38 allows the respective bolt 26 to rise under the action of the corresponding spring 40.

In known machines, such an adjustment system is provided but each screw 38 has a readily-operable head, such as knurled knob, for adjustment of a machine in operation in a factory; in the present machine, however, only the hexagonal recesses 42 are provided for operation with the aid of a cooperating tool, since it is necessary to adjust the positions of the cams 32 by means of the screws 38 only during initial assembly of the machine in a factory, to ensure that the cams are correctly aligned with respect to each other, alternative adjustment means being provided for use during operation of the machine.

In the machine according to the present invention the sector-support plate 14 has a dependent cylindrical flange 46, slidably engaged in a cooperating aperture, coaxial with the cylinder 22, in the base plate 12. The sector-support plate 14 also has a plurality of dependent, circumferentially spaced pins 48 each of which is engaged in a cooperating bore 50 in the base plate 12. Thus the sector-support plate 14 can slide vertically with respect to the frame 10 and to the cylinder 22, but is constrained by the pins 48 against rotation. The pins could alternatively be fixed to the base plate 12 and slidable in bores in the sector-support plate 14.

Figure 4:
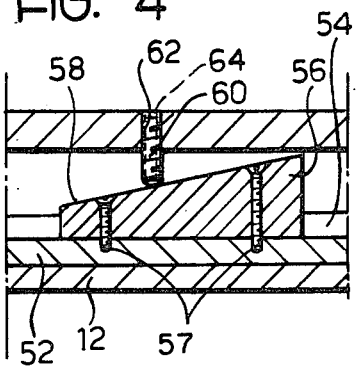
FIG. 4 is a sectional view taken on line IV—IV of FIG. 3.
Figure 5:
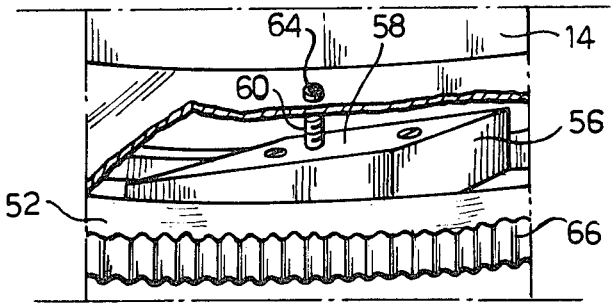
FIG. 5 is a perspective view of the same parts as appear in FIG. 4.

Between the sector-suppport plate 14 and the base plate 12 is an annular gap in which is located a setting ring 52, resting on the base plate 12, the inner cylindrical surface of which cooperates with the external surface of the flange 46. Referring to FIGS. 4 and 5 of the drawings, as well as to FIGS. 2 and 3, the setting ring 52 has a circular groove 54 in its upper face in which there are fixed, with equi-angular spacing, small wedge-shaped blocks 56 each of which has a inclined upper face 58. The blocks 56 are detachably secured to the setting ring 52 by means of screws 57. The inclined faces 58 all slope in the same circumferential direction and are of equal slope. In this embodiment a small wedge-shaped block 56 corresponds with each sector 18, although the number of blocks 56 and sectors 18 may differ.

The plate 14 is supported from the base plate 12 by means of equispaced, threaded grub screws 60, each engaged in a respective vertical threaded bore 62 in the support plate 14, and each bearing on an inclined face 58 of a respective wedge-shaped block 56, there being the same number of screws 60 as blocks 56. Each screw 60 has an hexagonal recess 64 in an upper face by which, with the aid of a suitable tool, the screw may be rotated to adjust the spacing of the plate 14 from the face 58 and hence from the base plate 12; the screws are adjusted during setting up of the machine to ensure that the axis of the plate 14 is exactly parallel to that of the needle cylinder 22.

The setting ring 52 has straight teeth 66 around its circumference which are meshed with the straight teeth of a pinion 68 keyed to the lower end of a vertical shaft 70 rotatably mounted in a bush 72 fixed in the sector-support plate 14. A disc 74 is keyed to the upper end of the shaft 70 and is provided with incised graduations which cooperate with a fixed reference notch 76 cut in the face of the sector-support plate 14.

The upper end of the shaft 70 is formed with a prismatic recess complimentary to the prismatic configuration of the end 78 of control key 80, accessible from outside the machine, is engaged. A ball grip or similar control member could alternatively be keyed on to the upper end of the shaft 70.

As will be understood, rotation of the key 80 fitted in the recess 78 causes a corresponding rotation of the shaft 70 which, in turn, due to the meshing of the pinion 68 with the teeth 66 of the ring 52 causes rotation of the setting ring 52 with its wedge-shaped blocks 56. The grub screws 60 bearing on the inclined faces 58 of the blocks 56 thus ride up or down the respective faces 58, each by the same amount, raising or lowering respectively the annular sector-support plate 14, which is guided for vertical movement by the pins 48 sliding in the bores 50 and by the flange 46. The cams 32 carried by the cam-support ring 16 supported on the sector-support plate 14 are thus raised or lowered by exactly the same amount, simultaneously by simple operation of the key 80.

The height through which the cams 32 are raised or lowered may be determined by the graduations on the disc 74 which may be calibrated according to any desired unit of measurement (for example, tenths of a millimeter).

What is claimed is:

1. A multiple-feed circular knitting machine, including:

a frame;

an upright-axis needle cylinder rotatably mounted in said frame;

a plurality of needles mounted in the periphery of said cylinder for vertical sliding movement;

a cam-support ring coaxially surrounding said needle cylinder, said ring being constrained against rotation and subdivided into a plurality of sectors;

cam means supported by each of said sectors for controlling said vertical movement of said cylinder needles;

an annular base plate fixed to said frame coaxially with said needle cylinder;

an annular sector support plate coaxially surrounding said needle cylinder, said support plate being vertically slidable with respect to said frame; constraint means constraining said support plate against rotation with respect to said frame, said support plate being located above said base plate and defining an annular gap between the support plate and the base plate;

a rotatable setting ring located in said annular gap and supported coaxially with and on said base plate;

a plurality of wedge-shaped blocks detachably secured with equi-angular spacing, onto said rotatable setting ring, each of said blocks having an inclined upper face, said inclined upper faces having equal slopes in the same circumferential direction;

a plurality of equi-angularly spaced screws each of which is engaged in a respective vertical threaded-through hole in the support plate and bears on the inclined upper face of one of said blocks for adjustably supporting said sector support plate on said rotatable setting ring through said blocks;

and common control means which are operable from the exterior of said machine to cause rotation of said setting ring in either sense to cause said screws to ride up or down said respective inclined faces by the same amount in order to vary the height of said sector support plate with respect to said needle cylinder.

2. The circular knitting machine of claim 1, wherein said common control means include a rotatable shaft, a toothed pinion keyed on to said rotatable shaft, teeth provided around the periphery of said setting ring and meshed with the teeth of said pinion, and operating means operating to rotate said shaft and accessible from outside said machine.

3. The circular knitting machine of claim 2, wherein said teeth of said setting ring and of said pinion are straight teeth and said rotatable shaft extends through said annular sector-support plate for rotation about a substantially vertical axis.

4. The circular knitting machine of claim 2, wherein said sector-support plate has an upper face, said upper facing being provided with a fixed reference notch, and wherein a graduated disc is keyed to said rotatable shaft and cooperates with said fixed reference notch.

5. The circular knitting machine of claim 1, wherein said annular sector-support plate has a dependent cylindrical flange, the outer surface of which cooperates with an inner cylindrical face of said setting ring.

6. The cirular knitting machine of claim 5, wherein said base plate has a circular opening, coaxial with said needle cylinder, in which said dependent flange of said sector-support plate is engaged for axial sliding movement.

7. The circular knitting machine of claim 1, wherein said constraint means comprise a plurality of upright pins fixed to one of said sector-support plate and said base plate and means defining a plurality of bores in the other of said sector-support plate and said base plate, each of said pins being engaged in a respective bore to constrain said sector-support plate against rotation, but being slidable in said respective bore to allow axial movement of said sector-support plate.

* * * * *